United States Patent [19]

Jenkins

[11] Patent Number: 4,478,357

[45] Date of Patent: Oct. 23, 1984

[54] CITRUS FRUIT JUICE DISPENSING APPARATUS

[75] Inventor: William K. Jenkins, Hazelwood, Mo.

[73] Assignee: Multiplex Company, Inc., St. Louis, Mo.

[21] Appl. No.: 471,872

[22] Filed: Mar. 3, 1983

[51] Int. Cl.[3] ..... B67D 5/56

[52] U.S. Cl. ..... 222/135; 222/129.1

[58] Field of Search ..... 222/129.1, 129.2, 129.3, 222/129.4, 146 C, 566; 239/432, 132.1; 366/336, 337, 338

[56] References Cited

U.S. PATENT DOCUMENTS 2,328,110 8/1943 Thompson et al. ..... 222/146 C 3,966,091 6/1976 Bencic ..... 222/129.1

*Primary Examiner*—Stanley H. Tollberg

*Assistant Examiner*—Andrew Jones

*Attorney, Agent, or Firm*—Senniger, Powers, Leavitt and Roedel

[57] ABSTRACT

Apparatus for reconstituting citrus fruit juice concentrate with water and dispensing the reconstituted juice into a cup comprising a refrigeration chamber for holding a container of concentrate above its freezing temperature, and structure for continuous circulation of cold carbonated water through the chamber, the container having an outlet for the concentrate and an inlet for air under pressure for pressurizing the concentrate. The apparatus further comprises dispensing valve structure with a mixing nozzle, a first passage for the flow of concentrate to the nozzle, a second passage for the flow of water to the nozzle and structure for regulating the pressure of tap water supplied to the nozzle.

4 Claims, 8 Drawing Figures

FIG. 1
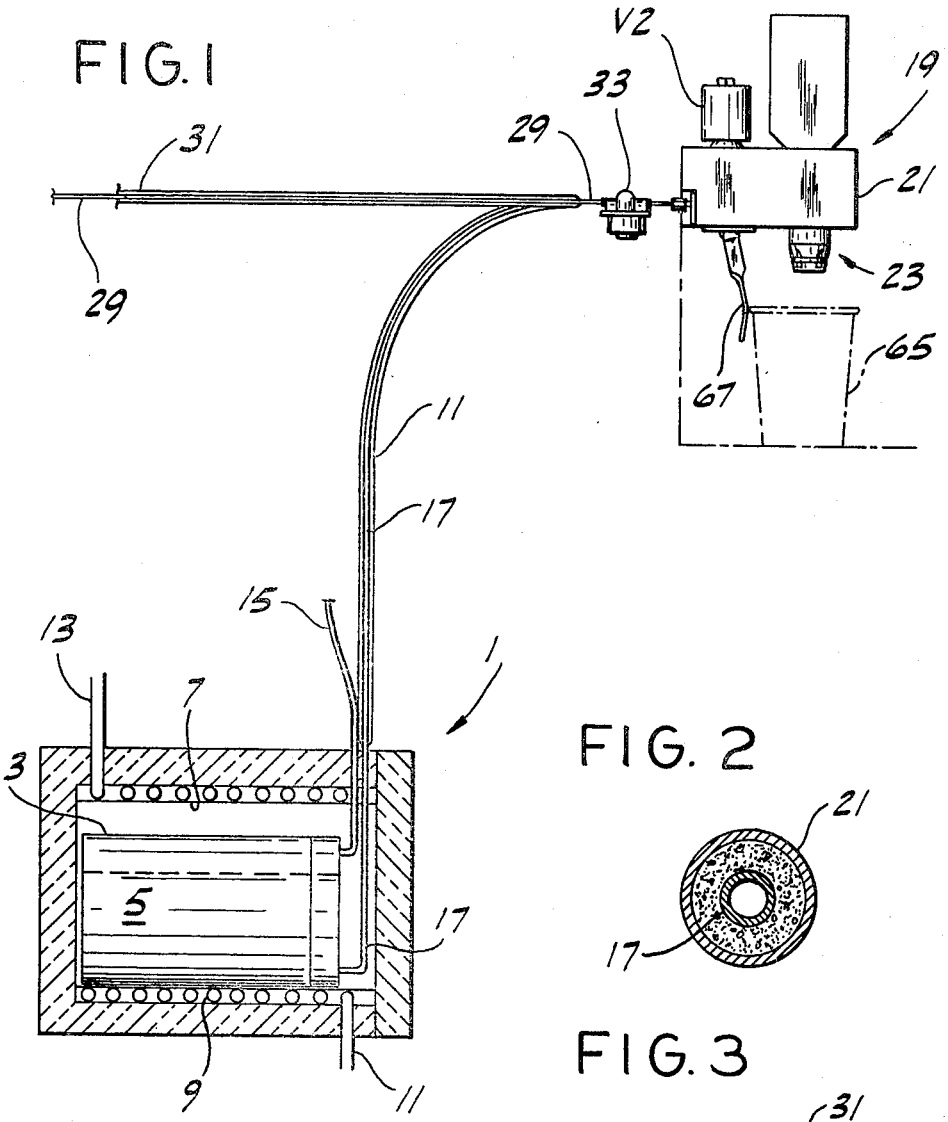
FIG. 2
FIG. 3
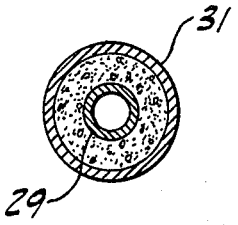

CITRUS FRUIT JUICE DISPENSING APPARATUS

BACKGROUND OF THE INVENTION

This invention relates to a citrus fruit juice dispensing apparatus and more particularly to such apparatus for use in fast food restaurants or like establishments for dispensing orange juice.

SUMMARY OF THE INVENTION

Among the several objects of the invention may be noted the provision of apparatus for efficiently reconstituting citrus fruit juice concentrate, particularly orange juice concentrate, with water (cold tap water) and dispensing the reconstituted fruit juice into a cup; the provision of such apparatus adapted to operate efficiently with citrus fruit juice concentrate which carries pulp and other solids such as may cause it to flow with difficulty; and the provision of such apparatus adapted to reconstitute the concentrate with water and dispense the reconstituted juice without clogging and without straining out the pulp and solids.

In general, apparatus of this invention comprises a refrigeration chamber for holding a container of concentrate at a temperature somewhat above its freezing temperature (e.g. 35°–40° F.). The chamber has means for continuous circulation of cold carbonated water therethrough for refrigeration and the container has an outlet for the concentrate and an inlet for air under pressure for pressurizing the concentrate. The apparatus further has dispensing valve means with a mixing nozzle extending downwardly therefrom, a first passage for the flow of concentrate to the nozzle and a second passage for flow of water to the nozzle, the flow of concentrate being controlled by the air pressure, and means for regulating the pressure of tap water supplied to the nozzle to control the flow of water to the nozzle. The mixing nozzle comprises a tubular body for entry of concentrate and water at the upper end thereof and exit of concentrate mixed with water at the lower end thereof. The body has a central hub at the lower end thereof and spokes extending between the hub and the peripheral wall of the body with the openings between the spokes providing for the exit of mixed concentrate and water. The body further has an upwardly facing internal annular shoulder intermediate the upper and lower ends of the body. A stem extends up from the hub and is secured at its lower end in the hub. A relatively thin flat mixing member of circular scalloped outline bears at its periphery on the shoulder and has a central opening receiving the stem. The scalloped outline provides openings through the member between the stem and the peripheral wall of the body for the flow of concentrate and water. There is means on the stem above said mixing member holding it on the shoulder. The stem further has a head at its upper end of smaller diameter than the internal diameter of the body at its upper end, this head having a recess therein. The first passage for the flow of water discharges it into the nozzle between the head and the peripheral wall of the body and the second passage for the concentrate discharges it down into the recess in the head for dispersion of the concentrate radially outwardly and mixing thereof with water.

Other objects and features will be in part apparent and in part pointed out hereinafter.

BRIEF DESCRIPTION OF THE DRAWINGS

FIG. 1 is a view generally showing apparatus of this invention, including a refrigeration chamber, multi-tube conduits and a dispensing valve means;

FIG. 2 is a cross section of a concentrate line within a carbonated water line;

FIG. 3 is a cross section of a tap water line within a carbonated water line;

Corresponding reference characters indicate corresponding parts throughout the several views of the drawings.

DESCRIPTION OF THE PREFERRED EMBODIMENT

Figure 4:
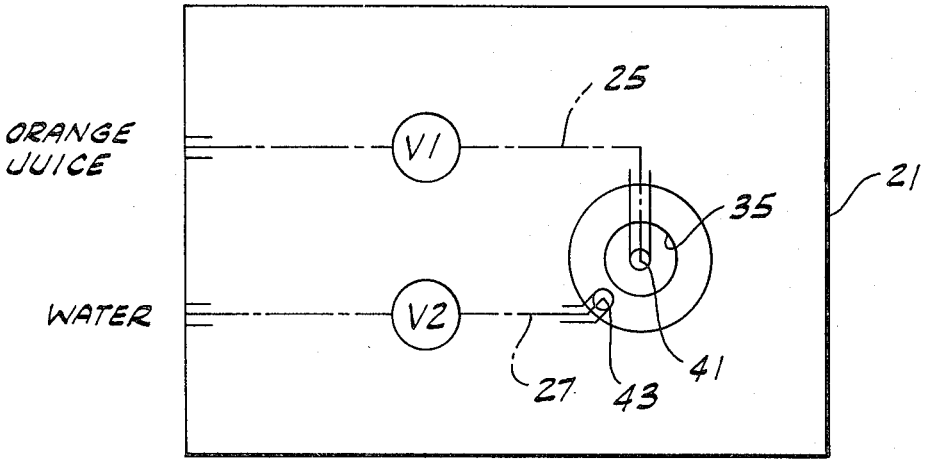
FIG. 4 shows diagrammatically the dispensing valve means.
Figure 6:
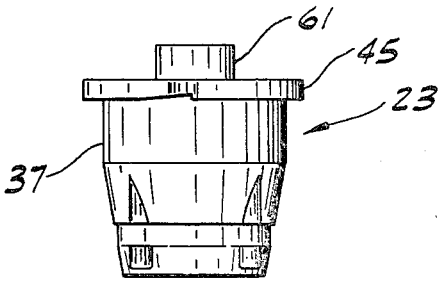
FIG. 6 is a side elevation of the mixing nozzle.
Figure 7:
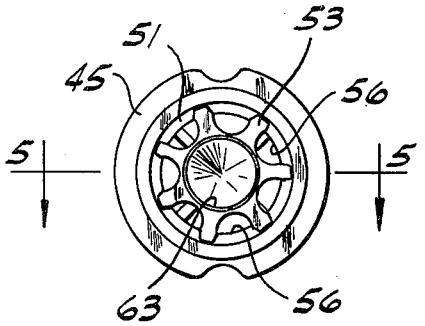
FIG. 7 is a top plan of the mixing nozzle.
Figure 8:
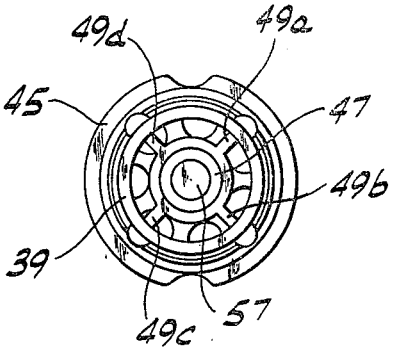
FIG. 8 is a bottom plan of the mixing nozzle.

Referring to the drawings, apparatus of this invention for reconstituting citrus fruit juice concentrate and especially orange juice concentrate with water and dispensing the reconstituted juice into a cup is shown to comprise a refrigeration chamber or cabinet 1 for holding a container 3 of concentrate 5 with the concentrate at a temperature somewhat above its freezing temperature, e.g. for holding the concentrate at a temperature in the range from about 35° F. to about 40° F. The apparatus of this invention is generally used in a fast food restaurant or like establishment which has a system for dispensing soft drinks including a dispensing tower having a number of dispensing valves for post-mix dispensing of soft drinks, with a refrigerated carbonated water supply system in which the carbonated water is continuously circulated for cooling purposes as well as for post-mixing carbonated drinks.

As shown in FIG. 1, the refrigeration chamber is generally rectangular in shape with a compartment 7 therein and openings for the passage of lines into the compartment 7. The chamber has a cooling coil 9. The container 3 is placed in the compartment 7 surrounded by coil 9 which constitutes means for the circulation of the refrigerated carbonated water, thereby allowing the carbonated water to keep the concentrate in the container cool. The carbonated water enters the chamber through inlet line 11 and exits from the chamber through outlet line 13. An air inlet line 15 passes through the top of the chamber and communicates with the container of concentrate near the top thereof. The air inlet line 15 provides air under pressure to the container for pressurizing the concentrate therein. A concentrate exit line 17 communicates with the container 3 near the bottom thereof for the flow of concentrate from the container. Outside the chamber 1, the concentrate exit line 17 passes through the carbonated water line 11 and communicates with dispensing valve means generally designated 19 as shown in FIGS. 1 and 2. The concentrate in line 17 is thereby kept cool by the refrigerated carbonated water flowing in line 11.

The dispensing valve means 19 comprises a valve body or block 21 of generally rectangular shape having a mixing nozzle 23 extending downwardly therefrom, a first passage 25 for flow of concentrate to the nozzle and second passage 27 for flow of water to the nozzle.

The second passage 27 is supplied with tap water via a tap water line 29 which is disposed within a carbonated water line 31. The carbonated water line 31 communicates with the refrigerated carbonated water supply (not shown) and keeps the tap water in the line cool. Valves V1 and V2 are provided for the first and second passages, respectively, for controlling the dispensing of the concentrate and water into the mixing nozzle 23. A pressure regulator 33 is suitably connected in the tap water line before the line enters the dispensing body 21 for regulating the pressure of the tap water supplied to the mixing nozzle 23.

Figure 5:
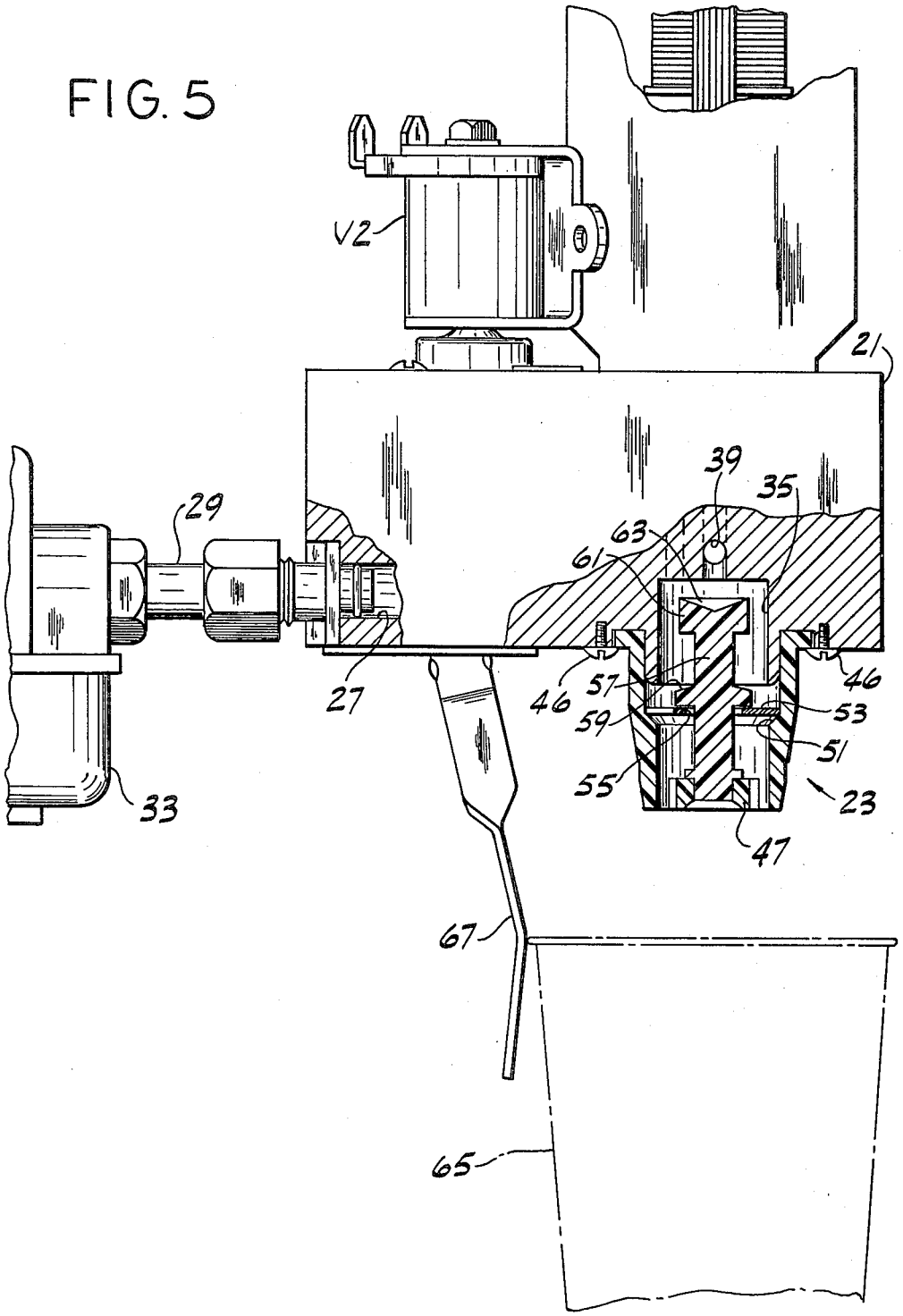
FIG. 5 is a side view of the dispensing valve means partly broken away to show the mixing nozzle, with the mixing nozzle shown in section on line 5—5 of FIG. 7.

The mixing nozzle 23, as shown in FIGS. 5–8, is attached to the bottom of the valve body 21 at an opening 35 in the body 21 extending downwardly therefrom. The nozzle 23 comprises a tubular body 37 for the entry of concentrate and tap water at the upper end thereof and the exit of concentrate mixed with water at the lower end thereof. The concentrate and tap water enter the nozzle 23 through ports 41 and 43, respectively, in the opening 35 of the body 21. Port 41 is situated such that the concentrate will enter the top of the nozzle in the center thereof. Port 43 is situated such that the tap water will enter along the inside of the wall of the nozzle. The nozzle body 37 has a flange 45 at its upper end which fits in a recess on the bottom of the body 21 and which is secured by means of screws 46 in position as shown in FIG. 5. A central hub 47 is located at the lower end of the nozzle body 37 and has spokes 49*a*, 49*b*, 49*c*, 49*d* extending between the hub and the peripheral wall 39 of the body. The openings between the spokes 49*a*–49*d* provide for the exit of mixed concentrate and water from the nozzle. The body 37 further has an upwardly facing internal annular shoulder 51 intermediate its upper and lower ends. A relatively thin and flat mixing member 53 bears on the periphery of the shoulder 51. This member is of circular scalloped outline with a central opening 55 therein. The scalloped outline provides openings 56 (see FIG. 7) through the member 55 for the flow of concentrate and water. A stem 57 extends up from the hub 47 and is secured at its lower end in the central opening of the hub. The stem 57 passes through the central opening 55 of the mixing member 53 and has a collar 59 constituting means above the mixing member 53 to hold it on the shoulder 51 of the tubular body 37. At the upper end of the stem 57 and centrally located in the upper end of the nozzle is a head 61 having a smaller diameter than the internal diameter of the body 37 at its upper end. This head 57 extends above the flange 45 of the nozzle and has a recess 63 therein for the dispersion of the concentrate radially outwardly as it enters the mixing nozzle 23.

In the operation of the apparatus, refrigerated carbonated water is continuously circulating from a supply (not shown) through line 31 and thence through line 11 and coil 9. With tap water line 29 in line 31, the tap water in line 29 is kept cool. The refrigerated carbonated water, circulating from line 31 through line 11 and coil 9 of the chamber 1, keeps the concentrate in line 17 and container 3 cool for dispensing into the cup 65 with the cool tap water. Lines 31 and 11 together constitute a conduit for delivery of cold carbonated water to the coil 9. Once the carbonated water has circulated through the coil 9 it exits via line 13 and back to the refrigerated carbonated water supply system. When a drink is desired, the cup is pressed against a lever 67 pivoted in the dispensing body 21 which opens valves V1 and V2 for flow of tap water and concentrate to the mixing nozzle 23. The concentrate is directed through port 41 and down into the recess 63 of the head for radially dispersing the concentrate outwardly and breaking down solid portions of the concentrate and mixes with the tap water while flowing through the openings in the mixing member. The water reconstitutes the concentrate into a juice and the mixture of tap water and concentrate passes through the openings in the hub of the nozzle into the cup.

The flow of concentrate from container 3 to the nozzle 23 is controlled by the air pressure supplied to the container 3 via line 15. The tap water pressure regulator 33 controls the flow of tap water to the nozzle.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. Apparatus for reconstituting citrus fruit juice concentrate with water and dispensing the reconstituted citrus fruit juice into a cup comprising a refrigeration chamber for holding a container of concentrate at a temperature somewhat above its freezing temperature, e.g. 35°–40° F., the chamber having means for continuous circulation of cold carbonate water therethrough for refrigeration, the container having an outlet for the concentrate and an inlet for air under pressure for pressurizing the concentrate, dispensing valve means having a mixing nozzle extending downwardly therefrom, a passage for flow of concentrate to the nozzle and a passage for flow of water to the nozzle, the flow of concentrate being controlled by the air pressure, means for regulating the pressure of tap water supplied to the nozzle to control the flow of water to the nozzle, said mixing nozzle comprising a tubular body for entry of concentrate and water at the upper end thereof and exit of concentrate mixed with water at the lower end thereof, said body having a central hub at the lower end thereof and spokes extending between the hub and the peripheral wall of said body with the openings between the spokes providing for exit of mixed concentrate and water, said body having an upwardly facing internal annular shoulder intermediate its upper and lower ends, a stem extending up from the hub and secured at its lower end in the hub, a relatively thin flat mixing member of circular scalloped outline bearing at its periphery on said shoulder and having a central opening receiving the stem, the scalloped outline providing openings through said member between the stem and the peripheral wall of the body for flow of concentrate and water, means on the stem above said mixing member holding it on the shoulder, said stem having a head at its upper end of small diameter than the internal diameter of the body at its upper end, said head having a recess therein, the passage for flow of water discharging it into the nozzle between the head and the peripheral wall of the body, the passage for concentrate discharging it down into the recess in said head for dispersion of the concentrate radially outwardly and mixing thereof with the water.

2. Apparatus as set forth in claim 1 wherein the means for continuous circulation of cold carbonated water through said chamber comprises a coil in the chamber and a conduit for delivery of cold carbonated water to the coil, and wherein the tap water is supplied to the dispensing valve means via a line passing through the carbonated water conduit.

3. Apparatus as set forth in claim 1 wherein the means for continuous circulation of cold carbonated water through said chamber comprises a coil in the chamber and a conduit for delivery of cold carbonated water to the coil, and wherein the concentrate is supplied from the container to the dispensing valve means via a line passing through the carbonated water conduit.

4. Apparatus as set forth in claim 3 wherein the tap water is supplied to the dispensing valve means via a line passing through the carbonated water conduit.

* * * * *